US006453898B1

(12) United States Patent
Altmann et al.

(10) Patent No.: US 6,453,898 B1
(45) Date of Patent: Sep. 24, 2002

(54) DEVICE TO COVER THE SIGHT ON HUNTING AND SPORTS BOWS

(76) Inventors: Frieder Altmann, Schweinbach 12 a, Pommersfelden (DE), 96178; Erich Hahn, S'ambach 31, Pommersfelden (DE), 96178

( * ) Notice: Subject to any disclaimer, the term of this patent is extended or adjusted under 35 U.S.C. 154(b) by 0 days.

(21) Appl. No.: 09/494,426

(22) Filed: Jan. 31, 2000

(51) Int. Cl.[7] ..... F41G 1/467
(52) U.S. Cl. ..... 124/87; 33/265
(58) Field of Search ..... 124/86, 87; 33/244, 33/265

(56) References Cited

U.S. PATENT DOCUMENTS 3,208,146 A * 9/1965 Nelson
3,746,423 A * 7/1973 Mills
4,785,791 A * 11/1988 Sloop ..... 124/87 X
5,253,423 A * 10/1993 Sullivan et al. ..... 33/265
5,454,169 A * 10/1995 Keller ..... 33/265
5,653,217 A * 8/1997 Keller ..... 124/87
5,749,352 A * 5/1998 McFarlin ..... 124/87

* cited by examiner

*Primary Examiner*—John A. Ricci

(57) ABSTRACT

A cover is provided to protect the sight of an archery bow from distortion caused by falling precipitation, regardless of the horizontal position of the bow. The bow is provided with a sight having a lens; the sight is attached to the bow by a bracket. A cover is pivotally attached to the bracket, and includes an upper protective hood over the sight, and a lower counterweight. The counterweight is of sufficient weight so that the cover will pivot about the bracket as the bow is pivoted about a horizontal axis, or laid down, so the hood will maintain its protective position above the sight.

1 Claim, 2 Drawing Sheets

DEVICE TO COVER THE SIGHT ON HUNTING AND SPORTS BOWS

During the last few years the compound bow has become more and more prominent in archery. A compound bow is a bow in which cables transmit the force based on a pulley block principle. These technically sophisticated bows are usually equipped with optical sights. The sights are firmly fastened to the bow and the connection can be adjusted by screws which allow adjustment of the sights to different distances.

These sights consist of a mount in which there is an optical lens. This lens is marked in the middle with a dot or reticule and, due to the enlargement, acts as an aiming telescope. In addition, a level is usually installed in this mount as well, to ensure that the bow is held straight when shooting the arrow.

Naturally these sights do not only offer advantages, but also have disadvantages which manifest themselves when it is raining. When it is raining, raindrops will fall on the lens from time to time, which break the light and make it impossible to continue shooting. It is not possible to wipe off the lens prior to shooting again, because this causes the lens to immediately fog up.

The current situation to cope with this problem is that the archer uses plastic bags, cases for eyeglasses, or similar devices to cover the sights, which are very complicated to handle. Moreover, the lens fogs up just the same due to the sealed in air and humidity.

There are also covers being used which are fastened to the optics with a rubber band, similar to a roof; however, the disadvantage here is that the sights face up when the bow is put down, thus leaving the sights unprotected again.

Presently, there is no cover which offers reliable protection for the optics from the elements when the arrow is being shot as well as when the bow is put down.

BRIEF SUMMARY OF THE INVENTION

This invention is a result of the problem that there is no cover for sights which offers protection from weather conditions when shooting the arrow, as well as when the bow is put down. This new cover automatically covers the sights in any position of the bow.

In order to withstand distortion from weather including falling precipitation, the optics must be reliably covered. This is achieved by a cover which is suspended like a pendulum and by way of gravity automatically moves over the optics.

Since the cover does not influence the shooting results at all and offers protection from weather influences as well as from reflections of sunlight and artificial light, it is equally suited for outside use and indoor use.

BRIEF DESCRIPTION OF THE DRAWINGS

An example of the invention is shown in the accompanying drawings, in which.

DETAILED DESCRIPTION OF THE INVENTION

Figure 1:
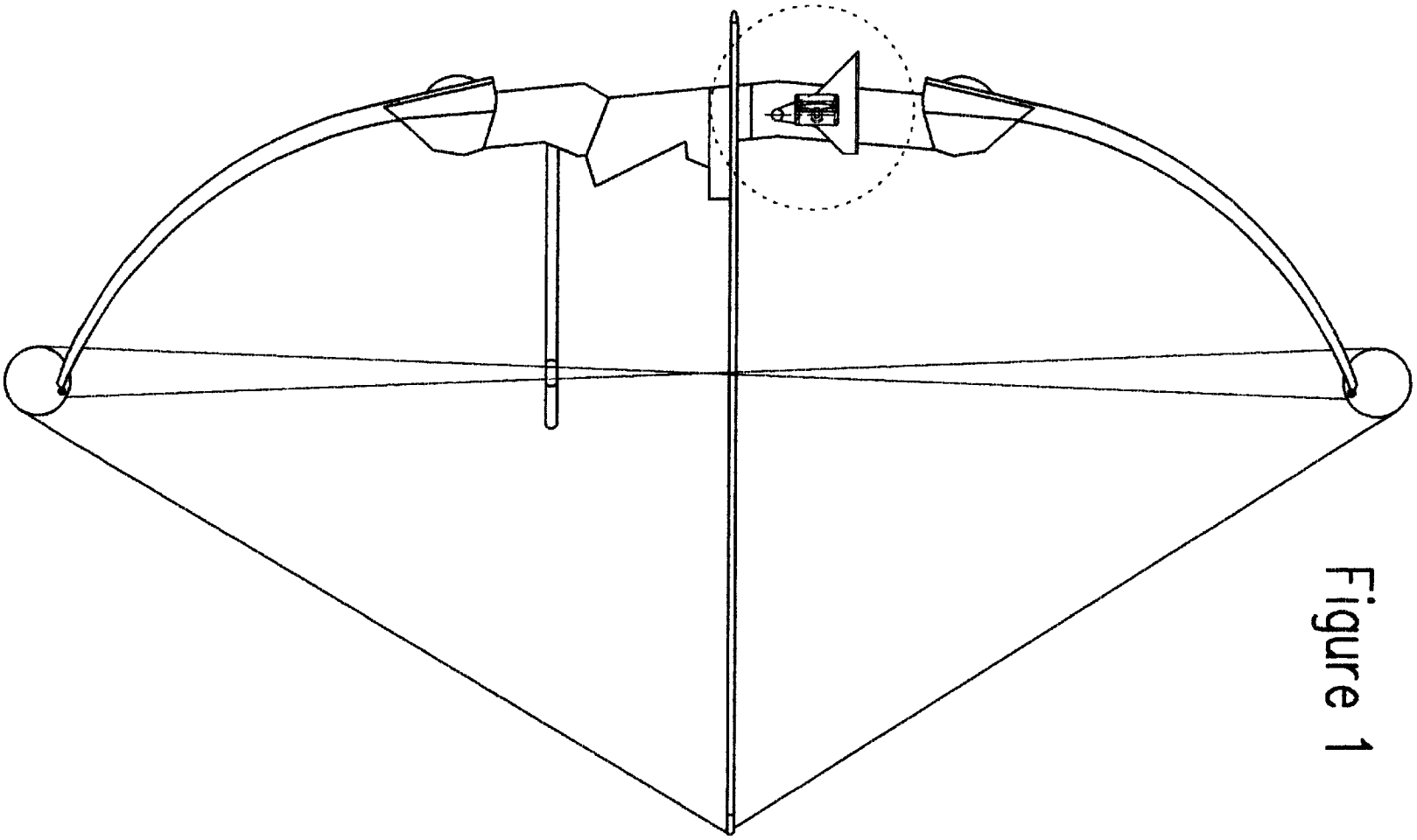
FIG. 1 shows a side elevational view of an archery bow including a sight with a protective cover of the invention, in the circled section.

FIG. 1 shows the bow as it would appear when held upright in a position to shoot an arrow. The bow includes a sight having a lens 1. Also shown is the inventive cover 3 which is effective to protect the lens from falling precipitation and undesired rays of light.

Figure 3:
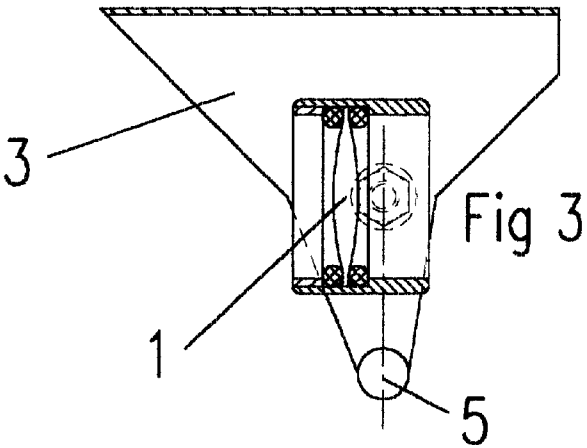
FIG. 3 shows a side elevational view of the bow sight and cover when the bow is held in the upright shooting position.
Figure 5:
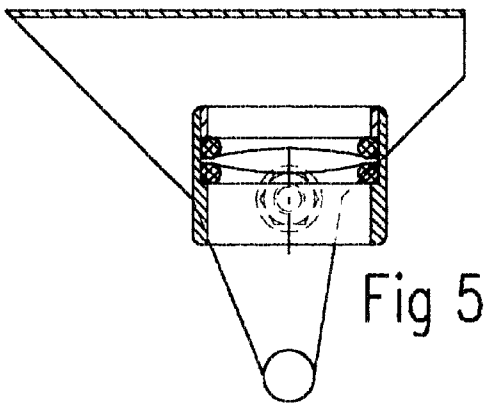
FIG. 5 shows a side elevational view of the bow sight and cover when the bow is laid down in a horizontal position.
Figure 2:
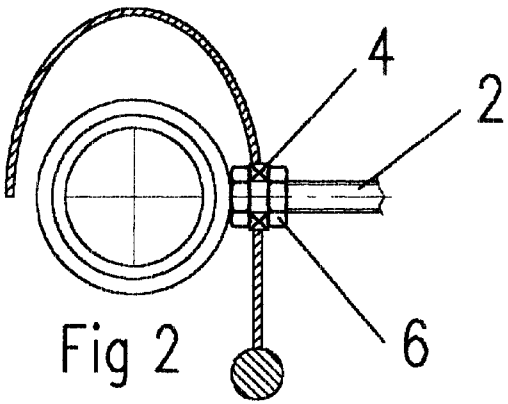
FIG. 2 shows a front elevational view of the bow sight and cover when the bow is held in the upright shooting position.

As shown in more detail in FIGS. 2 and 3, the sight 1 is mounted to the bow by means of a bracket 2. The cover 3 includes an upper hood portion, shown as dome-shaped and above the sight in the nature of an umbrella; a lower portion including a counterweight 5; and a mounting portion intermediate the hood portion and counterweight. The mounting portion includes an aperture to be received over the bracket 2. The mounting portion may be provided with a hinge 4 including ball bearings so that the cover 3 is able to freely pivot about the bracket 2. The cover may be prevented from moving horizontally along the bracket by means of fastenings such as nuts 6.

Figure 4:
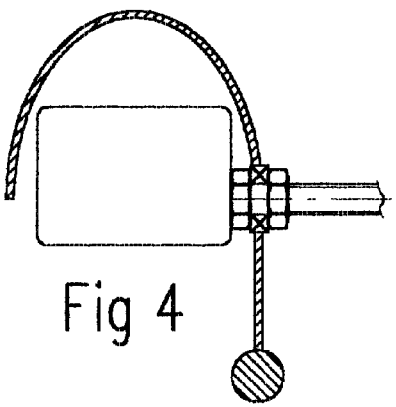
FIG. 4 shows a front elevational view of the bow sight and cover when the bow is laid down in a horizontal position.

As shown in FIGS. 3 and 4, the counterweight is of sufficient weight so that as the bow is tilted about a horizontal axis, the cover will pivot about the bracket so that the hood portion maintains its protective position over the sight; this will prevent precipitation from falling on the lens even when the bow is laid down during periods of non shooting. When the bow is again picked up in preparation for shooting, the lens will not be distorted by precipitation so shooting can be resumed without delay.

It is to be understood that the bow, sight, and mounting shown in the drawing are a representative example of conventional equipment, and the invention may be adapted to be used with a wide variety of existing equipment. The invention is only to be limited by the following claim.

What is claimed is:

1. A cover to protect the sight of an archery bow, the sight mounted to the bow by means of a bracket and including a lens subject to distortion by falling precipitation, the cover including a body having a hood portion, a mounting portion, and a counterweight portion; the mounting portion mounted to the bracket so that the hood portion extends above the sight to protect the sight from falling precipitation, and the counterweight portion extends downward from the mounting portion; the mounting portion being pivotally mounted to the bracket, and the counterweight portion having sufficient weight such that as the bow is tilted about a horizontal axis, the cover pivots about the bracket so that the hood portion maintains its protective position above the sight to prevent precipitation from falling on the sight even when the bow is not held upright.

* * * * *